US007063607B2

(12) United States Patent
Sim

(10) Patent No.: US 7,063,607 B2
(45) Date of Patent: Jun. 20, 2006

(54) BOWLING BALL RESURFACING APPARATUS

(76) Inventor: Sang-Bae Sim, 5-102, Yaksoo Apt., 645-21, Yoksam-dong, Kangnam-ku, Seoul (KR) 156-035

( * ) Notice: Subject to any disclaimer, the term of this patent is extended or adjusted under 35 U.S.C. 154(b) by 20 days.

(21) Appl. No.: 10/519,385

(22) PCT Filed: Jun. 26, 2003

(86) PCT No.: PCT/KR03/01258

§ 371 (c)(1),
(2), (4) Date: Dec. 27, 2004

(87) PCT Pub. No.: WO2004/002677

PCT Pub. Date: Jan. 8, 2004

(65) Prior Publication Data

US 2006/0111029 A1 May 25, 2006

(30) Foreign Application Priority Data

Jun. 26, 2002 (KR) ..... 10-2002-0035938

(51) Int. Cl.
*B24B 11/02* (2006.01)

(52) U.S. Cl. ..... 451/490; 451/178; 451/307

(58) Field of Classification Search ..... 451/490, 451/397, 307, 268, 178, 50; 15/21.2; 29/560
See application file for complete search history.

(56) References Cited

U.S. PATENT DOCUMENTS

| | | | | |
|---|---|---|---|---|
| 2,628,462 | A * | 2/1953 | Babcock | 451/397 |
| 2,707,851 | A * | 5/1955 | Strong | 451/57 |
| 3,249,957 | A * | 5/1966 | Secord | 15/21.2 |
| 3,289,354 | A * | 12/1966 | Stevens et al. | 451/50 |
| 3,484,996 | A * | 12/1969 | Gardner | 451/121 |
| 6,186,875 | B1 * | 2/2001 | Cook et al. | 451/268 |
| 6,439,982 | B1 * | 8/2002 | Klukos | 451/307 |
| 2003/0049996 | A1 * | 3/2003 | Nam | 451/178 |

* cited by examiner

*Primary Examiner*—David B. Thomas
*Assistant Examiner*—Robert Scruggs
(74) *Attorney, Agent, or Firm*—Lowe, Hauptman, Berner, LLP

(57) ABSTRACT

A bowling ball resurfacing apparatus comprises a housing, first and second vertical support rollers mounted to the housing for rotation about parallel vertical axes, each of the vertical support rollers adapted to make contact with the surface of the bowling ball at one lateral bottom side of the bowling ball, first and second horizontal support rollers mounted to the housing for supporting the bowling ball in cooperation with the vertical support rollers, each of the horizontal support rollers rotatable about horizontal axes and adapted to make contact with the surface of the bowling ball at the other lateral bottom side of the bowling ball, drive motors for causing the support rollers to rotate, and a grinding-and-polishing wheel assembly for making frictional contact with the surface of the bowling ball to grind or polish the bowling ball.

10 Claims, 11 Drawing Sheets

BOWLING BALL RESURFACING APPARATUS

FIELD OF THE INVENTION

The present invention relates to a bowling ball resurfacing device for cleansing, abrading, machining, polishing and furbishing a surface of spherical objects such as a bowling ball while causing the sphere to revolve in various directions.

BACKGROUND OF THE INVENTION

Frictional rolling contact between a bowling ball and a lane often leaves wear or scratch on the surface of the bowling ball. In particular, the bowling ball tends to make contact with the lane substantially at the same circumferential area thereof, which gives rise to an unbalanced partial wear of the bowling ball. Use of the scratched or unevenly worn bowling ball would make a bowling player feel it difficult to command, e.g., spin skills at his or her desire due mainly to the unpredictable movement of the bowling ball. Accordingly, the scratch and the unbalanced wear may adversely affect the score of a bowling game, thus reducing the amusement of the game played. This means that the bowling ball should be periodically resurfaced into a complete spherical shape.

There are a number of prior art references that disclose a device for automatically resurfacing the bowling ball. One of them is U.S. Pat. No. 5,613,896 that teaches a bowling ball resurfacing machine including three shafts each pivotally disposed at an angle of 120° in a manner as to support a bowling ball therein, three motors for rotating the corresponding shaft in a forward/reverse direction, and three cone-shaped abrading cups mounted on the shafts. Although this bowling ball resurfacing machine has its own advantages, the problem of unbalanced partial wear still remains unsolved because the rolling direction of the bowling ball cannot be vigorously changed during the resurfacing operation.

Another aspect of them is Korean Laid-open Patent Publication No. 2002-39093 that discloses a bowling ball resurfacing device for abrading and furbishing a surface of a bowling ball while causing the bowling ball to revolve in various directions. The bowling ball resurfacing device, filed by an applicant of the present invention to overcome the above-mentioned disadvantages, comprises a plurality of cylindrical supporting posts rotatable about respective vertical axes; a plurality of rollers mounted on the top end of each of the supporting posts in such a manner as to make a rolling contact with a lower portion of the bowling ball, each roller rotatable about a corresponding horizontal axis; second driving means for rotating the rollers about the respective horizontal axes; third driving means for rotating the supporting posts about the respective vertical axes; and abrading means for abrading and furbishing the bowling ball, in frictional contact with the surface of the bowling ball. This bowling ball resurfacing device first rotates the bowling ball about the horizontal axis by using the second driving means and the rollers, and angularly moves the rollers about the vertical axis by using the third driving means and the supporting posts, thereby abrading and furbishing the surface of the bowling ball while causing a rotational axis of the bowling ball supported by the rollers to revolve in various directions.

On the other hand, although this bowling ball resurfacing device has an advantage capable of evenly abrading and furbishing the surface of the bowling ball while causing the ball to revolve in various directions, it has also disadvantages that a structural complexity of the device causes its manufacturing difficulty, increases a manufacturing cost, and has many function troubles.

In addition, the prior art bowling ball resurfacing device has a problem that the bowling ball does not deviate in spite of an angular movement of the roller since a frictional force between the bowling ball and the roller is reduced due to a point contact of each other. In particular, an angular movement of a bowling ball having a slight weight is more difficult. These problems make it difficult to control the bowling ball, prevent the rotational axis of the bowling ball from varying in many directions, and make it impossible to uniformly abrade and furbish a surface of the bowling ball.

Further, the prior art bowling ball resurfacing device has a problem that the bowling ball is instantaneously wobbled owing to finger holes recessed in the surface of the bowling ball during the rotation of the ball by means of the rollers to thereby make it difficult to control the bowling ball. Especially, at the moment the roller pass by the finger holes, the bowling ball is sandwiched between the respective rollers, thereby burdening many loads to the second driving means and the power transmitting means. As a result, the service life of the second driving means and the power transmitting means is reduced due to its immoderate operation.

SUMMARY OF THE INVENTION

With the above-mentioned problems in mind, it is an object of the present invention to provide a resurfacing device for cleansing, abrading, polishing and furbishing the entire surface of spherical objects.

Another object of the invention is to provide a bowling ball resurfacing device for automatically and uniformly cleansing, abrading, polishing and furbishing the entire surface of a bowling ball without an unbalanced abrasion while causing the rotational direction of the bowling ball to vary in many different directions.

In accordance with an aspect of the invention, there is provided a bowling ball resurfacing device, comprising: a housing; a first and a second vertical support rollers mounted to the housing in a spaced-apart relationship with each other for rotation about parallel vertical axes, each of the vertical support rollers adapted to make contact with the surface of the bowling ball at one lateral bottom side of the bowling ball; a first and a second horizontal support rollers mounted to the housing for stably supporting the bowling ball in cooperation with the first and the second vertical support rollers, each of the horizontal support rollers rotatable about horizontal axes and adapted to make contact with the surface of the bowling ball at the other lateral bottom side of the bowling ball; roller driving means for rotating the first and the second vertical support rollers and the first and the second horizontal support rollers; abrading-and-polishing means for making frictional contact with the surface of the bowling ball to abrade or polish the bowling ball while the bowling ball is in rotation.

BEST MODE FOR CARRYING OUT THE INVENTION

The above and other objects and features of the present invention will become apparent from the following description of preferred embodiments given in conjunction with the accompanying drawings.

Figure 1:
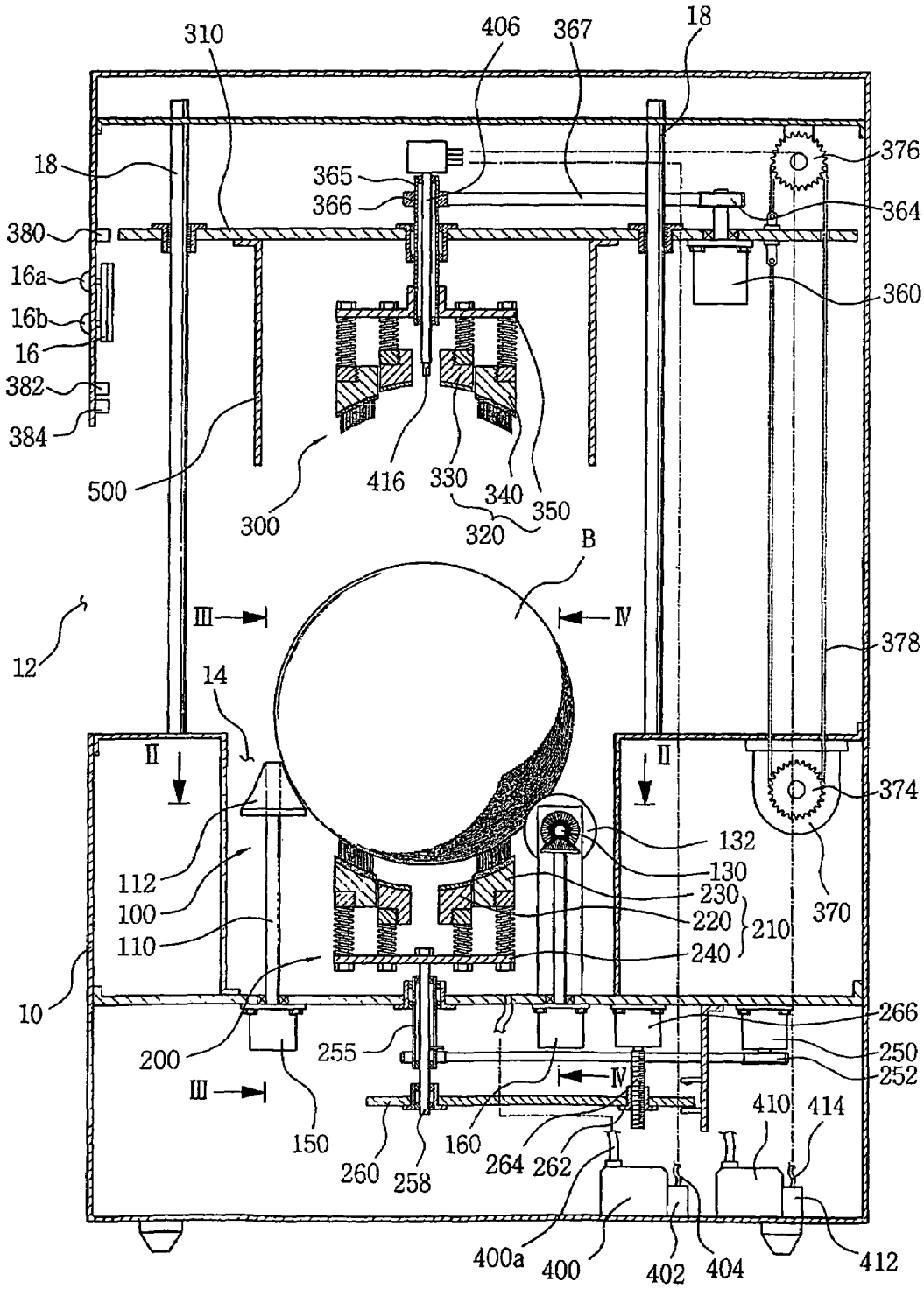
FIG. 1 is a cross sectional side view showing a bowling ball resurfacing device in accordance with the present invention.

First, referring to FIG. 1, a bowling ball resurfacing device of the present invention comprises a housing 10. The housing 10 has an inserting hole 12 for inserting a bowling ball B at its front section, and an abrading chamber 14 for abrading and polishing the inserted bowling ball B in its interior section. In addition, the housing 10 is provided with a control board 16 for controlling the resurfacing device, installed in its interior side, and a serious of push buttons 16*a* and a timer 16*b* for controlling the control board 16, arranged in its exterior side.

On the other hand, in the interior section of the housing, a revolving unit 100 for rotating the bowling ball B, a lower resurfacing unit 200 for abrading and polishing a lower surface of the bowling ball B, and an upper resurfacing unit 300 for abrading and polishing an upper surface of the bowling ball B are incorporated.

Figure 2:
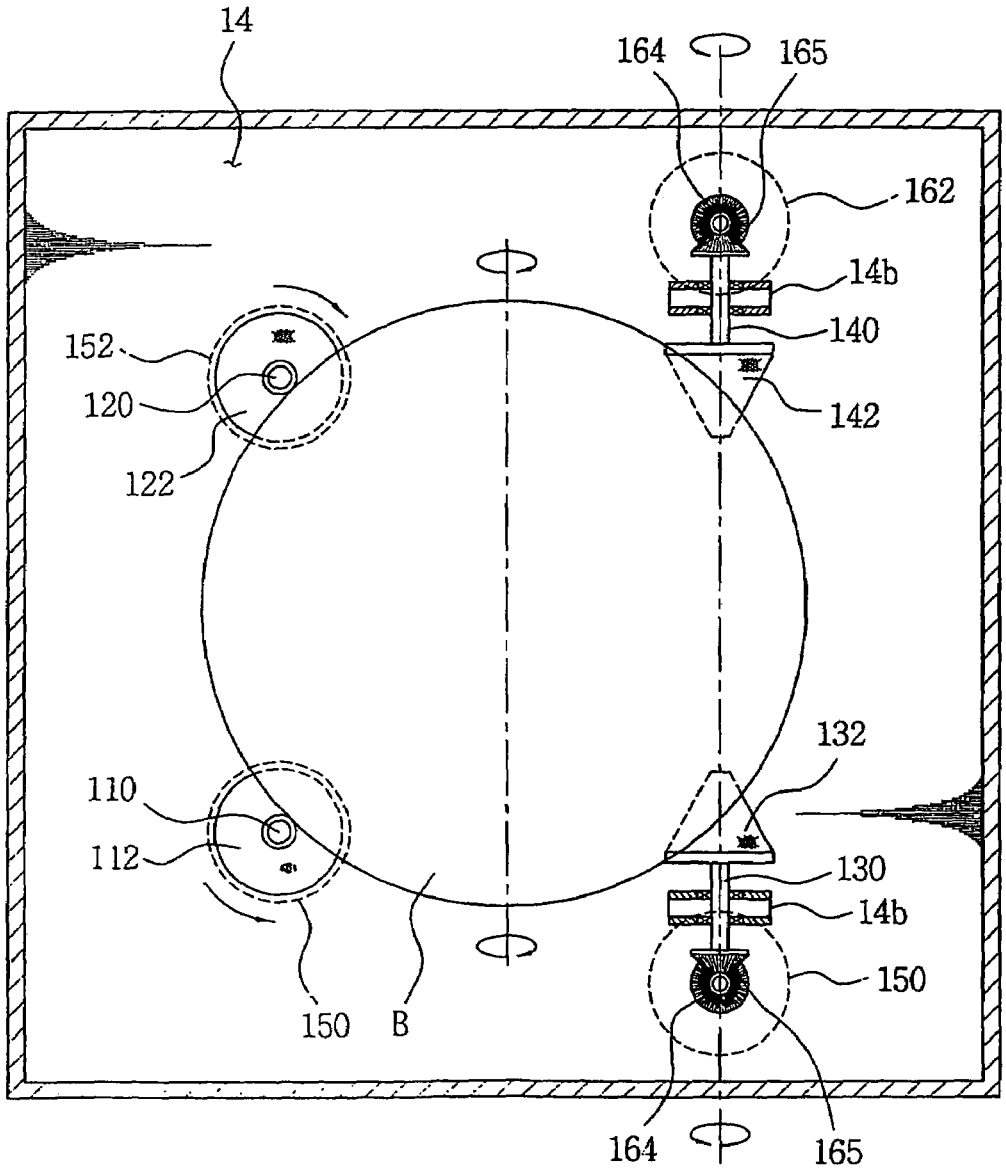
FIG. 2 is a cross sectional view of line II—II in FIG. 1, illustrating a first and a second vertical supporting rollers and a first and a second horizontal supporting rollers incorporated in the bowling ball resurfacing device in accordance with the present invention.
Figure 3:
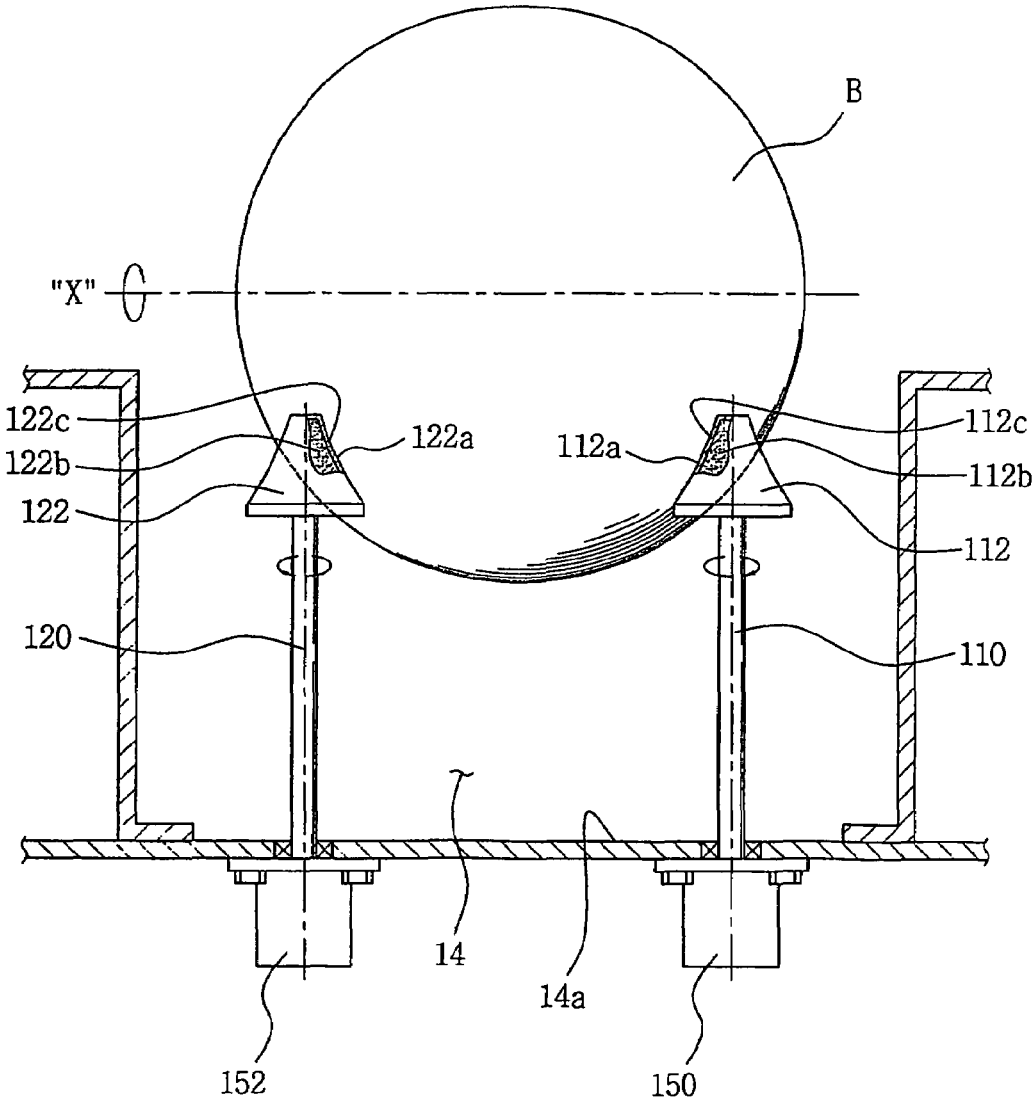
FIG. 3 is a cross sectional view of line III—III in FIG. 1, depicting a constitution of the first and the second vertical supporting rollers.

As shown in FIG. 2, the revolving unit 100 has a pair of first and second vertical driving shafts 110 and 120, and a pair of first and second horizontal driving shafts 130 and 140. As shown in FIG. 3, the first and the second vertical driving shafts 110 and 120 are installed in a bottom surface 14*a* of the abrading chamber 14, rotatable about a vertical axis. Each of the shafts is provided with first and second vertical supporting rollers 112 and 122 mounted at its end in parallel relationship, having a substantial cone shape. The cone shaped first and second supporting rollers 112 and 122 functions to support the bowling ball in holding up state, and has supporting surfaces 112*a* and 122*a* for supporting the bowling ball B. The supporting surfaces 112*a* and 122*a* have a predetermined curvature to be conformed to the exterior surface of the bowling ball B, thereby to support both lower surfaces of the bowling ball B, respectively. Further, the first and the second vertical supporting rollers 112 and 122 are provided with respective bodies 112*b* and 122*b* made of rubber having elasticity for increasing a contact efficiency with the bowling ball B, and respective textures 112*c* and 122*c* for covering an exterior surface of the body 112*b* and 122*b*. The respective bodies 112*b* and 122*b*, if necessary, may be changed since it is detachable from the first and the second vertical driving shafts 110 and 120. In addition, the textures 112*c* and 122*c* are constituted not only to roll the bowling ball B but also to polish and cleanse the surface of the bowling ball B.

Figure 4:
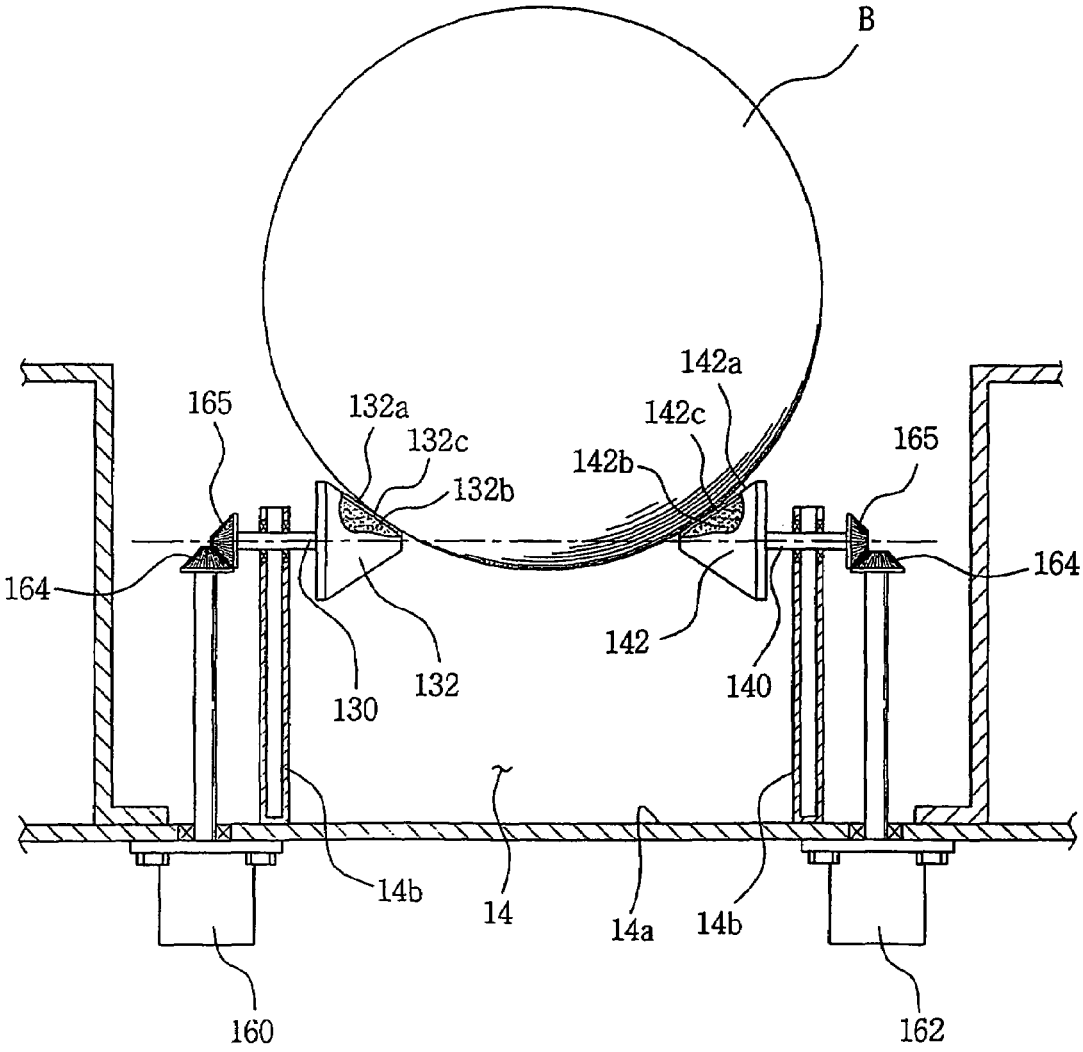
FIG. 4 is a cross sectional view of line IV—IV in FIG. 1, depicting a constitution of the first and the second horizontal supporting rollers.

On the other hand, as shown in FIG. 4, the first and the second horizontal driving shafts 130 and 140 are aligned with each other to form a concentric axis relationship and installed to be rotatable about the horizontal axis. The first and the second horizontal driving shafts 130 and 140 are rotatably mounted to a bracket 14*b* fixed to the bottom surface 14*a* of the abrading chamber 14, respectively, and have a first horizontal supporting roller 132 and a second horizontal supporting roller 142, having a cone shape, installed at respective ends with face to face. The conical first and second horizontal supporting rollers 132 and 142 are provided with respective supporting surfaces 132*a* and 142*a* for cooperating with the first and the second vertical supporting rollers 112 and 122 to support the lower surface of the bowling ball B by using the four points supporting method. Similarly, the first and the second horizontal supporting rollers 132 and 142 are provided with respective bodies 132*b* and 142*b* made of rubber having a predetermined elasticity, and respective textures 132*c* and 142*c* for covering an exterior surface of the body 132*b* and 142*b*. The respective bodies 132*b* and 142*b*, if necessary, may be changed since it is detachable from the first and the second horizontal driving shafts 130 and 140. In addition, the textures 132*c* and 142*c* are constituted not only to roll the bowling ball B but also to polish and cleanse the surface of the bowling ball B.

Referring again to FIG. 3, the revolving unit 100 is provided with first and second driving means for driving the respective first and second vertical driving shafts 110 and 120. The first and the second driving means are provided with first and second driving motors 150 and 152 for driving the first and the second vertical driving shafts 110 and 120, respectively. The first and the second driving motors 150 and 152 rotate the first and the second vertical driving shafts 110 and 120 to rotate the first and the second vertical supporting rollers 112 and 122 located at upper ends thereof, respectively. At this time, the first and the second driving motors 150 and 152 are constituted to rotate the first and the second vertical supporting rollers 112 and 122 in opposite directions to each other. The reason for this is that the first and the second vertical supporting rollers 122 should be rotated in opposite directions to each other to cause the bowling ball B supported by the rollers to rotate about the horizontal axis "X".

More specifically, the first and the second driving motors 150 and 52 rotate the first and the second vertical supporting rollers 112 and 122 in opposite directions to each other. As a result, the oppositely rotating first and second vertical supporting rollers 112 and 122 are contacted with both lateral portions S of the bowling ball B, respectively, as shown in FIG. 5*a*, to rotate the bowling ball B in the direction "X" about the horizontal axis.

On the other hand, the second vertical supporting roller 122 is intermittently rotated in the reverse direction, i.e., the same direction as the first vertical supporting roller 112. Of course, the second driving motor 122 is provided with reverse rotating means for intermittently rotating the second vertical supporting roller 122 in the reverse direction. Therefore, the second vertical supporting roller 122 is intermittently rotated in the reverse direction same as the first vertical supporting roller 112 to cause the first and the second vertical supporting rollers 112 and 122 to rotate in the same direction together, to thereby change the rotating shaft of the bowling ball B to a vertical axis "Z" as shown in FIG. 5*b*.

Figure 5A:
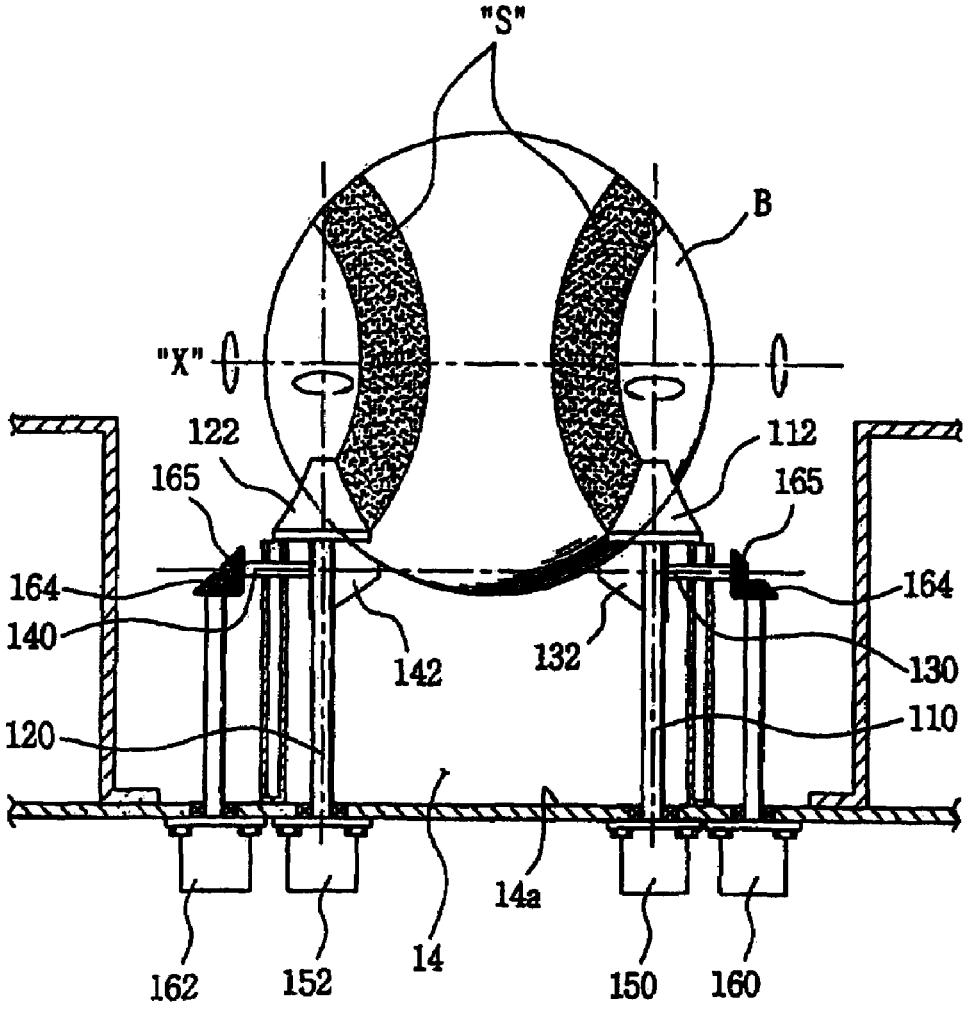
FIGS. 5*a* and 5*b* are views illustrating an operation principle of the first and the second vertical supporting rollers and the first and the second horizontal supporting rollers.
Figure 5B:
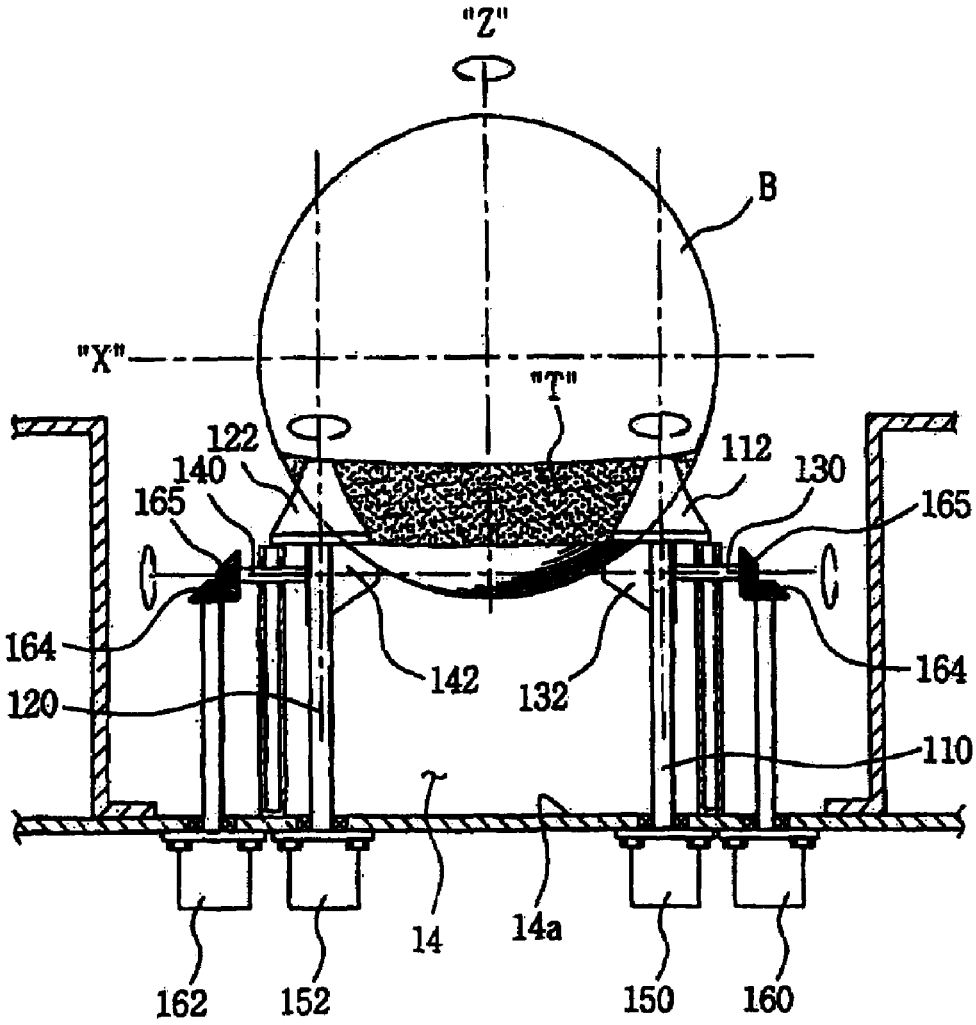

More specifically, in the condition that the second vertical supporting roller 122 and the first vertical supporting roller 112 are rotated in opposite directions to each other to revolve the bowling ball B about the horizontal axis "X" as shown in FIG. 5*a*, the second vertical supporting roller 122 is suddenly rotated in the reverse direction as shown in FIG. 5*b*. Then, the second vertical supporting roller 122 is rotated in the same direction as the first vertical supporting roller 112 to contact with a lower surface portion T of the bowling ball B, thereby rotating the bowling ball B about the vertical axis "Z". After a lapse of a predetermined time, the second driving motor 152 is rotated again in its original direction to revolve the second vertical supporting roller 122 in the opposite direction to the first vertical supporting roller 112 to contact with the both lateral portions S of the bowling ball B, to thereby rotating the bowling ball B about the horizontal axis "X" again as shown in FIG. 5*a*. That is to say, as the rotational direction of the second vertical supporting roller 122 is changed intermittently, the rotational axis of the bowling ball B is converted from "X" to "Z" and again from "Z" to "X", thereby changing its rotational direction in various directions.

Referring again to FIG. 4, the bowling ball resurfacing device in accordance with the present invention is provided with a third and a fourth driving means for driving the first horizontal driving shaft 130 and the second horizontal driving shaft 140, respectively. The third and the fourth driving means are provided with a third and a fourth driving motors 160 and 162 for rotating the first and the second horizontal driving shafts 130 and 140, respectively. The first horizontal driving shaft 130 is coupled to the third driving motor 160, and the second horizontal driving shaft 140 is coupled to the fourth driving motor 162, by means of a pair of driving and driven bevel gears 164 and 165, respectively.

The third and the fourth driving means rotate the first and the second horizontal driving shafts 130 and 140 to rotate the first and the second horizontal supporting rollers 132 and 142, to thereby revolve the bowling ball B supported on the upper portion. In this connection, the third and the fourth driving motors 160 and 162 rotate the first and the second horizontal supporting rollers 132 and 142 in the same direction, and the first and the second horizontal supporting rollers 132 and 142 are cooperated with the first and the second vertical supporting rollers 112 and 122 to rotate the bowling ball B in the same direction as shown in FIG. 2. Especially, the fourth driving motor 162 is incorporated to be intermittently rotated in the reverse direction together with the second driving motor 152 of the second driving means intermittently driven in the reverse direction to cooperate with the second driving motor 152 to thereby vary the rotational direction of the bowling ball B.

On the other hand, the third and the fourth driving motors 160 and 162 may vary a rotational speed ratio of the first and the second vertical supporting rollers 112 and 122 versus the first and the second horizontal supporting rollers 132 and 134, thereby causing the textures 132*c* and 142*c* to abrade or polish the surface of the bowling ball B. That is to say, when the rotational speed of the first and the second horizontal supporting rollers 132 and 134 is faster than that of the first and the second vertical supporting rollers 112 and 122, the textures 132 and 142 mounted thereon is rotated more rapidly to abrade or polish the surface of the bowling ball B.

In addition, the first and the second horizontal supporting rollers 132 and 134 rotate the bowling ball more rapidly than the first and the second vertical supporting rollers 112 and 122 to bias the bowling ball B to the first and the second vertical supporting rollers 112 and 122, thereby maximizing the contacting force of the bowling ball relative to the first and the second vertical supporting rollers 112 and 122.

Next, the lower resurfacing unit 200 for resurfacing the lower surface of the bowling ball B will be described in connection with FIG. 1. The lower resurfacing unit 200 has a abrading-polishing means frictionally contacted with the lower surface of the bowling ball B.

The abrading-polishing means include a lower wheel assembly 210 for polishing or abrading the lower surface of the bowling ball B. The lower wheel assembly 210 includes a abrading wheel 220 disposed in its center, an annular polishing wheel 230 disposed around the abrading wheel 220, and a supporting plate 240 for supporting the abrading wheel 220 and the polishing wheel 230.

The abrading wheel 220 includes a wheel disk 222, and a wheel body 224 in threaded engagement with the wheel disk 222. The wheel disk 222 is provided with a number of guide bars 222*a* movably inserted into the supporting plate 240, and a number of springs 224*b* inserted around the guide bars 224*a*, respectively. The guide bars 222*a* guide the wheel disk 222 to move with respect to the supporting plate 240 in the direction of approaching or separating to/from the bowling ball B. The number of springs 224*b* resiliently bias the wheel disk 222 in the direction of approach to the bowling ball B, and cause the wheel disk 222 and the wheel body 224 mounted thereon to resiliently move with respect to the supporting plate 240.

The wheel body 224 is provided with an abrading surface 224*a* for contacting with the surface of the bowling ball B, and attached to the abrading surface 224*a* is a doughnut shaped abrading element 225 such as a sand paper, a diamond paper, etc. The abrading element 225, for abrading the surface of the bowling ball B, is attached to the abrading surface 224*a* by an attaching means such as a Velcro fastener, if necessary, easily detachable from the abrading surface 224*a*. Similarly, the wheel body 224 is in threaded engagement with the wheel disk 222, if necessary, also detachable from the wheel disk 222.

On the other hand, the polishing wheel 230 includes a wheel disk 232 and a wheel body 234 in threaded engagement with the wheel disk 232. The wheel disk 232 is provided with a number of guide bars 232*a* movably inserted into the supporting plate 240, and a number of springs 232*b* inserted around the guide bars 232*a*, respectively. The guide bars 232*a* guide the wheel disk 232 to move with respect to the supporting plate 240 in the direction of approaching or separating to/from the bowling ball B. The number of springs 234*b* resiliently bias the wheel disk 232 in the direction of approach to the bowling ball B, and cause the wheel disk 232 and the wheel body 234 mounted thereon to resiliently move with respect to the supporting plate 240.

The wheel body 234 is provided with a polishing surface 234*a* for conforming to the surface of the bowling ball B, and attached to the abrading surface 234*a* is a polishing element, for example, a polishing brush 235. The polishing brush 235 is attached to the polishing surface 234*a* by an attaching means such as a Velcro fastener, if necessary, easily detachable from the abrading surface 234*a*. Similarly, the wheel body 234 is in threaded engagement with the wheel disk 232, if necessary, also detachable from the wheel disk 232.

Figure 7:
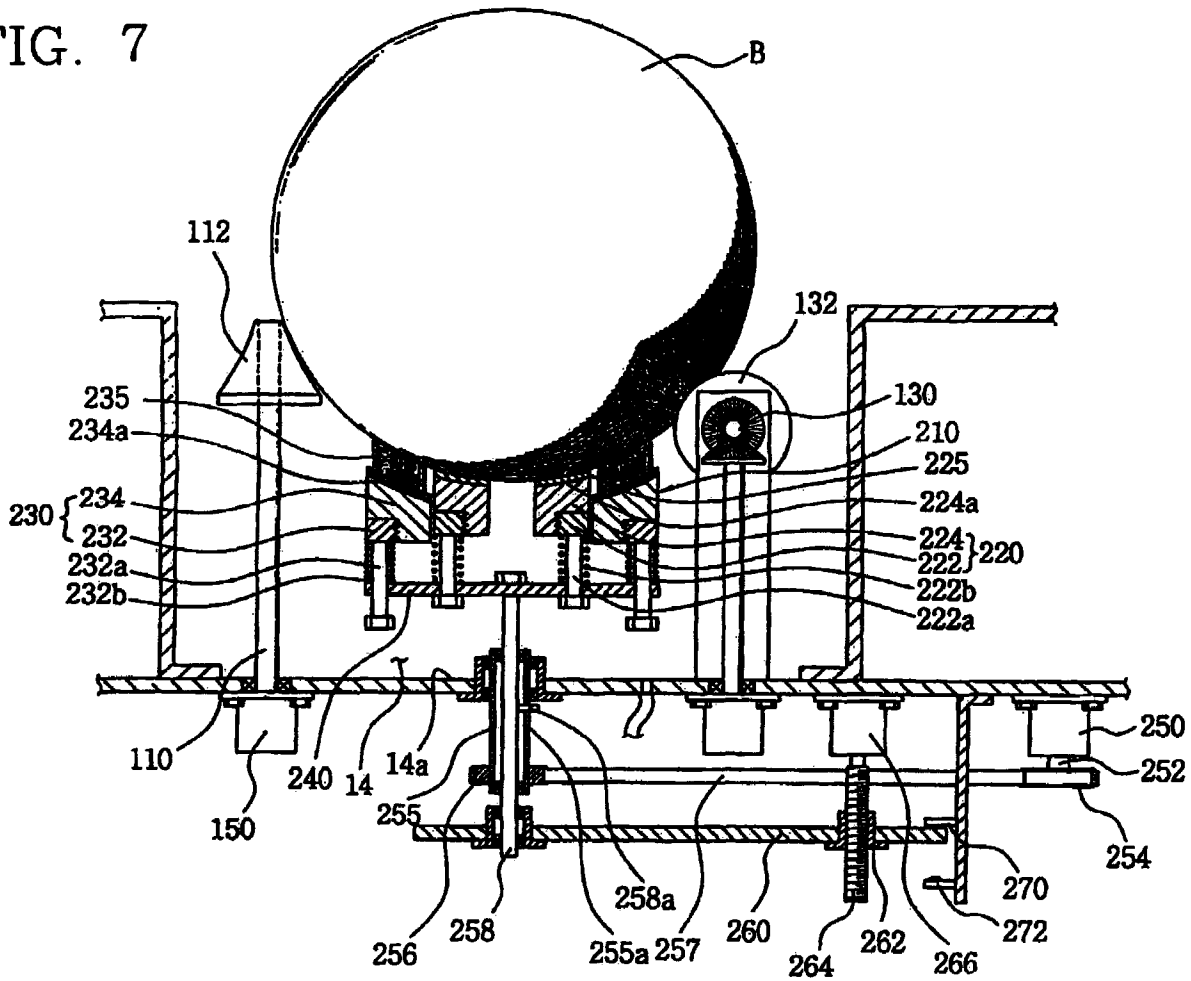
FIG. 7 is a view depicting an operation principle of the lower resurfacing unit.

On the other hand, the polishing surface 234*a* of the polishing wheel 230 is more protruded than the abrading surface 224*a* of the abrading wheel 220. The reason for this is that the polishing brush 235 of the polishing wheel 230 should primarily contact the surface of the bowling ball B prior to the abrading element 225 of the abrading wheel 220, i.e., the polishing wheel 230 should be used firstly. At this time, the polishing wheel 230 is always in contact with the lower surface of the bowling ball B. When the supporting plate 240 of the lower wheel assembly 210 is biased to the surface of the bowling ball B, as shown in FIG. 7, the abrading wheel 220 moves forward to be protruded more than the polishing wheel 230; thereby contacting with the surface of the bowling ball B. At this time, the polishing wheel 230 is in contacted with the surface of the bowling ball B to be compressed by the supporting plate 240.

Referring again to FIG. 6, the lower resurfacing unit 200 has a driving means for rotating the lower wheel assembly 210. The driving means is provided with a driving motor 250. The driving motor 250 is provided with an output shaft 252 at which a driving pulley 254 is installed. The driving means are provided with a hollow power transmission shaft rotatably installed at the bottom surface 14*a* of the abrading chamber 14. A driven pulley 256 is installed at the exterior surface of the power transmission shaft 255, and connected to the driving pulley 254 of the driving motor 250 by a belt 257. The power transmission shaft 255, connected to the driving pulley 254 of the driving motor 250, is rotated in high speed by power transmitted from the driving motor 250.

In addition, the driving means are provided with a rotary shaft 258, with supporting the supporting plate 240 of the lower wheel assembly, installed through the power transmission shaft 225. Especially, the power transmission shaft 255 has a slot 255*a* formed along the longitudinal direction, and the rotary shaft 258 has a protruded pin 258*a* for passing through the slot 255*a*, as a result, the rotary shaft 258 is capable of integrally rotating with the power transmission shaft 255 and coincidently moving along the longitudinal direction.

The driving means rotate the lower wheel assembly 210 in high speed through the driving motor 250, the power transmission shaft 255 and the rotary shaft 258, thereby abrading, polishing and furbishing the surface of the bowling ball B more effectively. On the other hand, the polishing wheel 230 of the lower wheel assembly 210 is protruded more than the abrading wheel 220 thereof, thus, the polishing wheel 230 is only contacted with the surface of the bowling ball B.

Further, the lower resurfacing unit 200 has biasing means for biasing the supporting plate 240 of the lower wheel assembly 210 to the bowling ball B to cause the abrading wheel 220 to be contacted with the surface of the bowling ball B. The biasing means includes a lifting plate 260 for supporting the rotary shaft 258 supporting the supporting plate 240, a nut 262 fixedly mounted on the lifting plate 260, a threaded shaft 264 in threaded engagement with the nut 262, and a lifting motor 266 for forwardly or reversely rotating the threaded shaft 264.

When the biasing means rotate the threaded shaft 264 forwardly by using the lifting motor 266, as shown in FIG. 7, the nut 262 is elevated along the threaded shaft 264, thus the lifting plate 260 is also elevated, as a result, the rotary shaft 258 supported by the lifting plate 260 is similarly elevated. Eventually, the lower wheel assembly 210 supported by the rotary shaft 258 is also elevated to be biased to the bowling ball B, the abrading wheel 220 of the biased lower wheel assembly 210 is protruded more than the polishing wheel 230, and the protruded abrading wheel 230 is contacted with the surface of the bowling ball B to abrade the surface of the bowling ball B.

On the other hand, the biasing means include limiting means for limiting an elevation width of the lower wheel assembly 210 to prevent the lower wheel assembly 210 from over elevating or descending during the process of biasing the lower wheel assembly 210. The limiting means include a first limit switch 270 and a second limit switch 272 for detecting an elevated position or a descended position of the lifting plate 260. The first and the second limit switches 270 and 272 are contacted with one side of the lifting plate 260 to stop the lifting motor 266.

Next, the upper resurfacing unit 300 for abrading the upper surface of the bowling ball B will be explained with reference to FIG. 1. First, the upper resurfacing unit 300 includes an lifting plate 310 installed at the vertical posts 18 of the housing 10, and an abrading-polishing means installed at the lifting plate 310.

The abrading-polishing means include an upper wheel assembly 320, in contact with the surface of the bowling ball B, for abrading or polishing the upper surface of the bowling ball B. The upper wheel assembly 320 includes an annular abrading wheel 330, an annular polishing wheel 340 disposed around the abrading wheel 330, and a supporting plate 350 for supporting the abrading wheel 330 and the polishing wheel 340.

Figure 8:
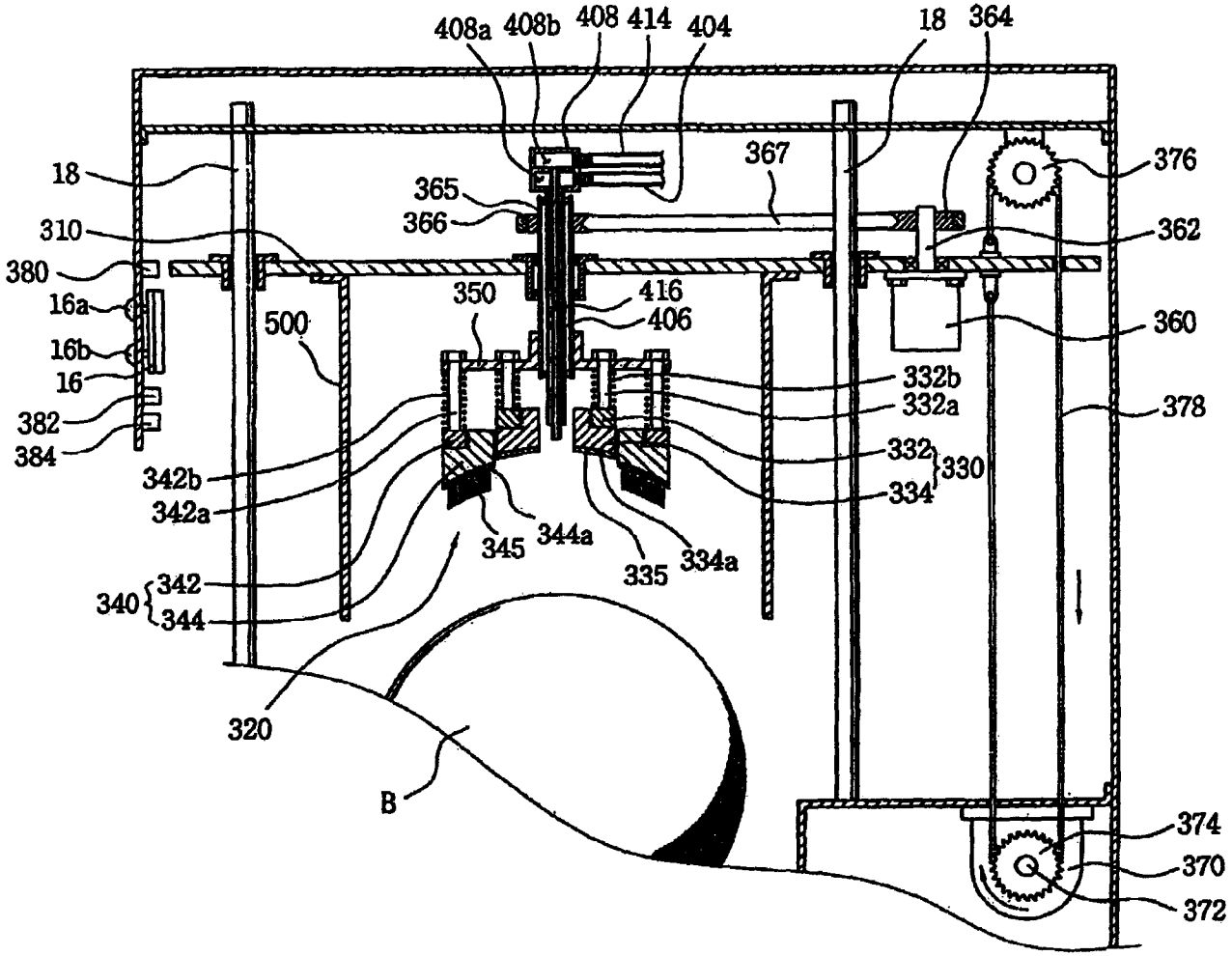
FIG. 8 is an enlarged cross-sectional view illustrating an upper resurfacing unit incorporated in the bowling ball resurfacing device in accordance with the present invention.

The abrading wheel 330, as shown in FIG. 8, includes a wheel disk 332, and a wheel body 334 in threaded engagement with the wheel disk 332. The wheel disk 332 is provided with a number of guide bars 332*a* movably inserted into the supporting plate 350, and a number of springs 332*b* inserted around the guide bars 332*a*, respectively. The guide bars 332*a* guide the wheel disk 332 to move with respect to the supporting plate 350 in the direction of approaching or separating to/from the bowling ball B. The number of springs 332*b*, resiliently bias the wheel disk 332 in the direction of approach to the bowling ball B, and cause the wheel disk 332 and the wheel body 334 mounted thereon to resiliently move with respect to the supporting plate 350.

The wheel body 334 is provided with a abrading surface 334*a* for contacting with the surface of the bowling ball B, and attached to the abrading surface 334*a* is a doughnut shaped abrading element 335 such as a sand paper, a diamond paper, etc. The abrading element 335, for abrading the surface of the bowling ball B, is attached to the abrading surface 334*a* by an attaching means such as a Velcro fastener, if necessary, easily detachable from the abrading surface 334*a*. Similarly, the wheel body 334 is in threaded engagement with the wheel disk 332, if necessary, also detachable from the wheel disk 332. In addition, the abrading element 335 attached to the wheel body 334 has a more large roughness than that of the abrading element 225 of the abrading wheel 230 attached to the lower resurfacing unit 200.

On the other hand, the polishing wheel 340 includes a wheel disk 342 and a wheel body 344 in threaded engagement with the wheel disk 342. The wheel disk 342 is provided with a number of guide bars 342*a* movably inserted into the supporting plate 350, and a number of springs 342*b* inserted around the guide bars 342*a*, respectively. The guide bars 342*a* guide the wheel disk 342 to move with respect to the supporting plate 350 in the direction of approaching or separating to/from the bowling ball B. The number of springs 342*b* resiliently bias the wheel disk 342 in the direction of approach to the bowling ball B, and cause the wheel disk 342 and the wheel body 344 mounted thereon to resiliently move with respect to the supporting plate 350.

The wheel body 344 is provided with a polishing surface 344*a* for conforming to the surface of the bowling ball B, and attached to the abrading surface 344*a* is a polishing element, for example, a polishing brush 345. The polishing brush 345 is attached to the polishing surface 344*a* by an attaching means such as a Velcro fastener, if necessary, easily detachable from the abrading surface 344*a*. Similarly, the wheel body 344 is in threaded engagement with the wheel disk 342, if necessary, also detachable from the wheel disk 342.

Figure 10:
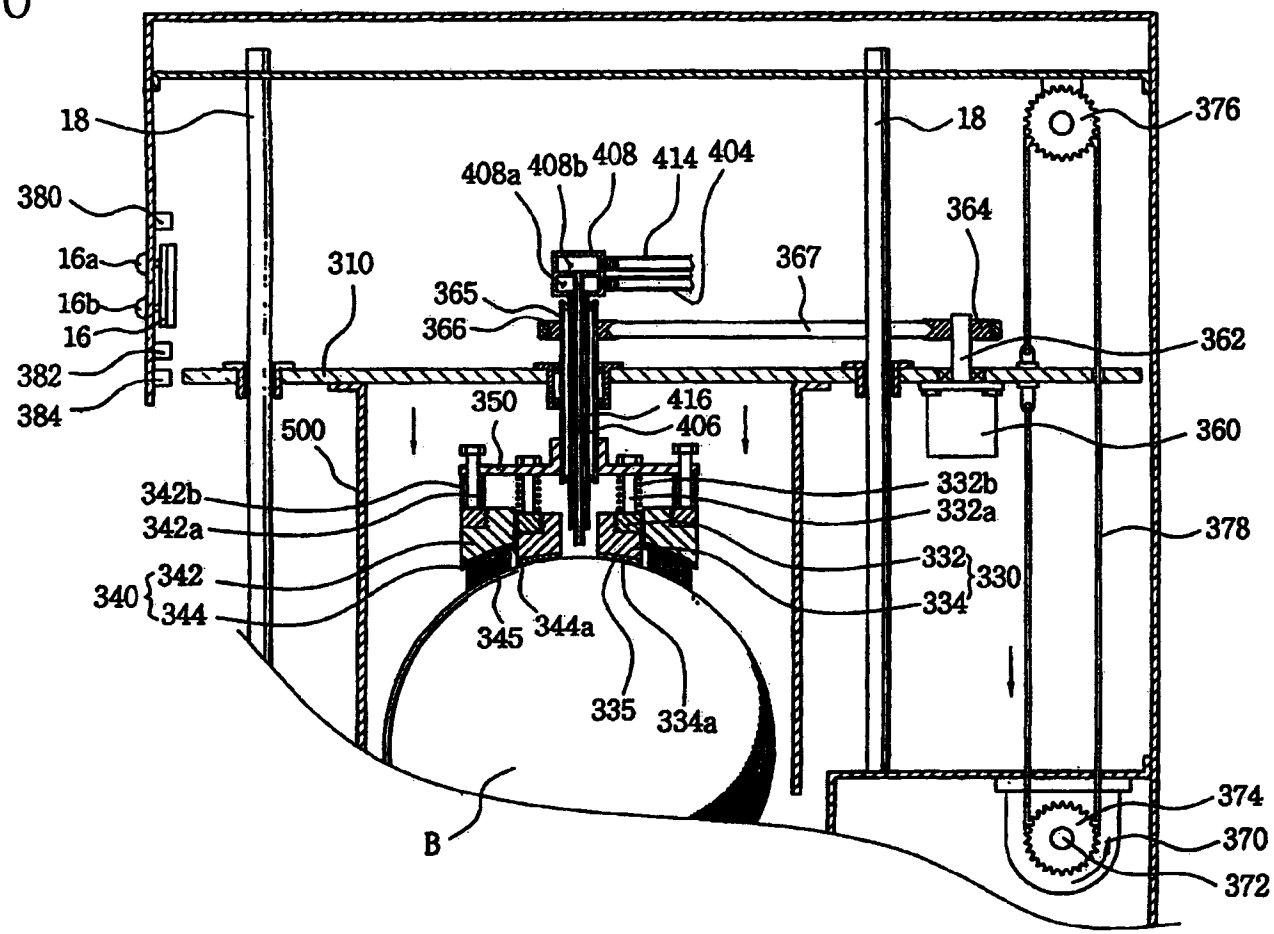

On the other hand, the polishing surface 344*a* of the polishing wheel 340 is more protruded than the abrading surface 334*a* of the abrading wheel 330. The reason for this is that the polishing brush 345 of the polishing wheel 340 should primarily contact the surface of the bowling ball B prior to the abrading element 335 of the abrading wheel 330, i.e., the polishing wheel 340 should be used firstly. On the other hand, as shown in FIG. 10, when the supporting plate 350 of the upper wheel assembly 320 is biased to the bowling ball B, contacting the polishing wheel 340 of the upper wheel assembly 320 with the surface of the bowling ball B, the abrading wheel 330 is moved forwardly to be protruded more than the polishing wheel 340, thereby causing the abrading wheel 330 to contact with the surface of the bowling ball B.

Referring again to FIG. 8, the upper resurfacing unit 300 has a driving means for rotating the abrading-polishing means. The driving means is provided with a driving motor 360 installed at the lifting plate 310. The driving motor 360 is provided with an output shaft 362 at which a driving pulley 364 is installed. The driving means are provided with a rotary shaft 365 rotatably installed at the lifting plate 310, supporting the upper wheel assembly. A driven pulley 366 is installed at the exterior surface of the rotary shaft 365, and connected to a driving pulley 364 of the driving motor 360 by a belt 367. The rotary shaft 365 connected to the driving pulley 364 of the driving motor 360 is rotated with high speed by a power transmitted from the driving motor 360, thereby rotating the upper wheel assembly supported at an end of the rotary shaft 365.

The driving means rotate the upper wheel assembly 320 with high speed, thereby causing the upper wheel assembly 320 to abrade, polish and furbish the surface of the bowling ball B more effectively.

On the other hand, the driving means of the upper resurfacing unit 300 are, as shown in FIG. 1, reversely driven with respect to the driving means of the lower resurfacing unit 200. Therefore, the lower wheel assembly 210 of the lower resurfacing unit 200 is reversely rotated with respect to the upper wheel assembly 320 of the upper resurfacing unit 300. When the lower wheel assembly 210 and the upper wheel assembly 320 are rotated in the same direction, the bowling ball B may be rotated about the vertical axis together with the lower wheel assembly 210 and the upper wheel assembly 320.

Referring again to FIG. 8, the upper resurfacing unit 300 is provided with biasing means for biasing the upper wheel assembly 320 to cause the polishing wheel 340 and the abrading wheel 330 to contact with the surface of the bowling ball B.

The biasing means include the lifting plate 310 installed at the supporting posts 18 of the housing movably up and down, lifting means for moving upwards and downwards the lifting plate 310. Especially, the lifting means include an lifting motor 370 installed at the lower side of the housing 10, a driving sprocket 374 installed at an output shaft 372 of the lifting motor 370, a driven sprocket 376 rotatably installed at the upper side of the housing 10, and a chain having its one end fixed to a lower surface of the lifting plate 310 via the driving sprocket 374 and the other end fixed to an upper surface of the lifting plate 310 via the driven sprocket 376.

Figure 9:
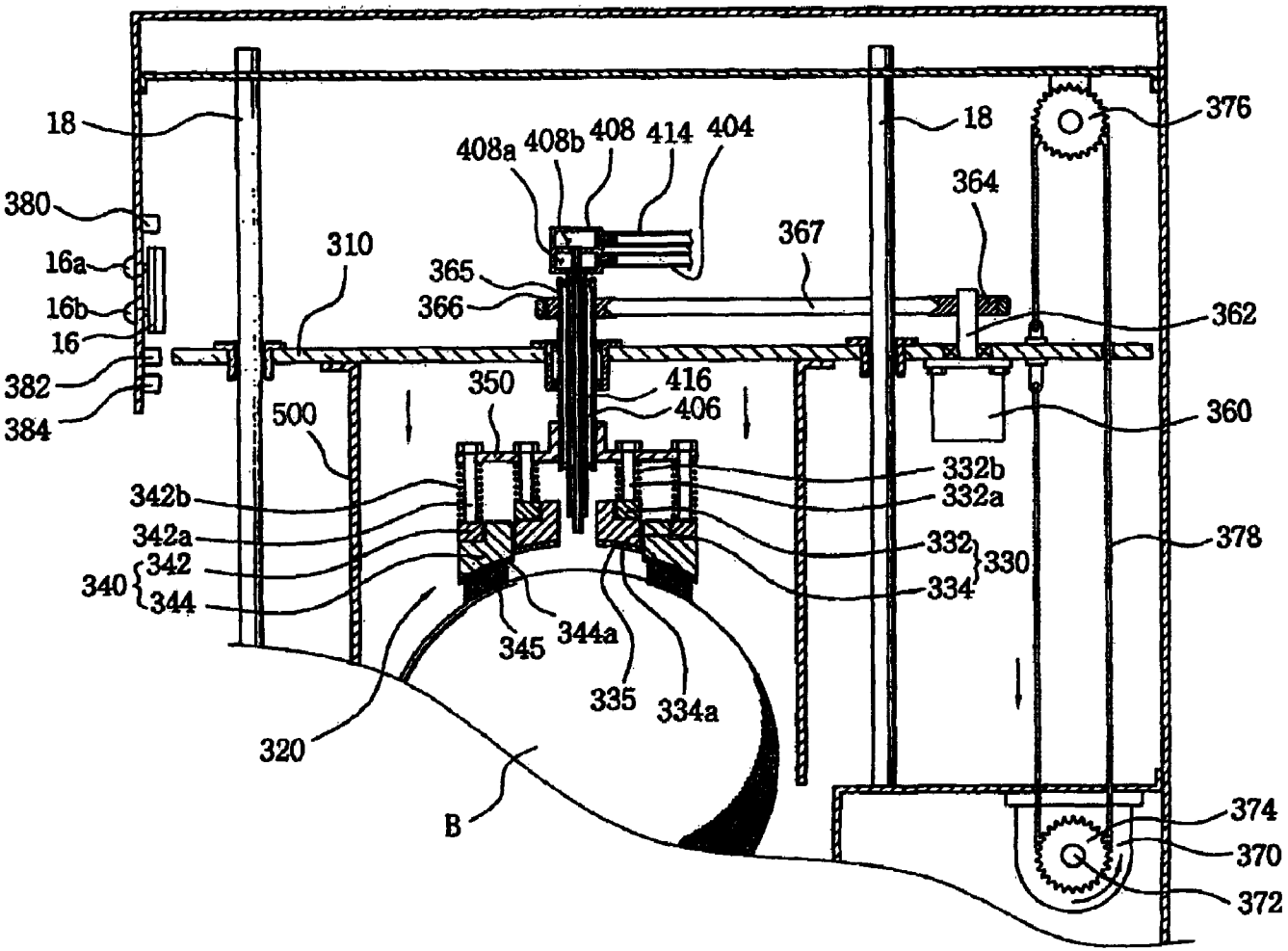
FIGS. 9 and 10 are views illustrating an operation of the upper resurfacing unit in accordance with the present invention.

As shown in FIG. 9, the biasing means cause the lifting motor 370 to rotate the driving sprocket 374 forwardly. Then, the driving sprocket 374 circulates the chain to move downwards the lifting plate 310, thereby biasing the upper wheel assembly 320 to the surface of the bowling ball B. Especially, the upper wheel assembly 320 is biased to cause the polishing wheel 340 of the upper wheel assembly 320 to contact with the surface of the bowling ball B.

When the driving sprocket 374 is further rotated, as shown in FIG. 10, the driving sprocket 374 further rotates the chain 378 to further move downwards the lifting plate 310, thereby further biasing the upper wheel assembly 320 to the surface of the bowling ball B. Especially, the upper wheel assembly 320 is further biased to cause the abrading wheel 330 of the upper wheel assembly 320 to contact with the surface of the bowling ball B.

On the other hand, the biasing means are provided with an lifting motor control means for controlling an operation of the lifting motor 370 to fix a location of the upper wheel assembly 320 at a preparation position of the most upper location as shown in FIG. 8, a first position contacted the polishing wheel with the bowling ball B as shown in FIG. 9, and a second position contacted the abrading wheel with the bowling ball B as shown in FIG. 10.

The lifting motor control means include a first detecting switch 380, a second detecting switch 382, and a third detecting switch 384, disposed in order from an upper portion to detect an elevating position of the lifting plate 310. The first detecting switch 380 detects the preparation position of the upper wheel assembly 320 to stop the operation of the lifting motor 370 as shown in FIG. 8, the second detecting switch 382 detects the first position of the upper wheel assembly 320 to stop the operation of the lifting motor 370 as shown in FIG. 9, and the third detecting switch 384 detects the second position of the upper wheel assembly 320 to stop the operation of the lifting motor 370 as shown in FIG. 10.

Referring again to FIG. 1, the bowling ball resurfacing device in accordance with the present invention includes an abrading fluid supplying means for supplying abrading fluid to the surface of the bowling ball B, and a polishing fluid supplying means for supplying polishing fluid to the surface of the bowling ball B.

The abrading fluid supplying means include an abrading fluid reservoir 400 installed at the bottom surface of the housing 10, a hydraulic pump 402 for pumping the abrading fluid from the reservoir 400, an abrading fluid feeding hose 404 for feeding the pumped abrading fluid to an upper end of the rotary shaft 365 of the upper resurfacing unit 300, and a hollow abrading fluid injection pipe 406 inserted into the hollow rotary shaft 365 to inject the fed abrading fluid to the upper surface of the bowling ball B. Especially, the hollow abrading fluid injection pipe 406 is, as shown in FIG. 8, inserted in an inner surface of the rotary shaft 365, and its end is disposed in an interior part of the abrading wheel 330.

In this connection, the abrading fluid injection pipe 406 and the abrading fluid feeding hose 404 is connected by an adapter 408 having a first chamber 408*a* in fluid communication with the abrading fluid injection pipe 406 and the abrading fluid feeding hose 404.

On the other hand, as shown in FIG. 1, the polishing fluid supplying means include a polishing fluid reservoir 410 installed at the bottom surface of the housing 10, a hydraulic pump 412 for pumping the polishing fluid from the reservoir 410, a polishing fluid feeding hose 414 for feeding the pumped polishing fluid to an upper end of the rotary shaft 365 of the upper resurfacing unit 300, and a polishing fluid injection pipe 416 inserted into the hollow abrading fluid injection pipe 406 to inject the fed polishing fluid to the upper surface of the bowling ball B. Especially, the polishing fluid injection pipe 406 is, as shown in FIG. 8, inserted in an inner surface of the abrading fluid injection pipe 406, and its end is disposed in an interior part of the annular abrading wheel 330. In this connection, the polishing fluid injection pipe 416 and the polishing fluid feeding hose 414 is connected by the adapter 408 having a second chamber 408*b* in fluid communication with the polishing fluid injection pipe 416 and the polishing fluid feeding hose 414.

In this connection, the abrading fluid supplying means are preferably incorporated to be operated during the abrading wheel 330 abrades the bowling ball B, similarly, the polishing fluid supplying means are preferably incorporated to be operated during the polishing wheel 340 polishes the bowling ball B. Of course, it is also possible that the abrading fluid supplying means and the polishing fluid supplying means are coincidently operated to coincidently supply the abrading fluid and the polishing fluid. The abrading fluid supplying means and the polishing fluid supplying means are operated under control of a control board 16.

On the other hand, as shown in FIG. 1, the abrading fluid reservoir 400 of the abrading fluid supplying means is in fluid communication with the bottom surface 14*a* through a return hose 400*a* to thereby enable a collection of an abrading fluid dropped in the bottom surface 14*a* of the abrading chamber 14 after the abrasion of the bowling ball B.

Further, the bowling ball resurfacing device of the present invention is provided with a shielding member 500 for shielding the abrading fluid and the polishing fluid dispersed on the surface machining of the bowling ball B. The shielding member 500 has a rectangular tube shape that covers the surroundings of the bowling ball B, and is attached to the lifting plate 310 to be moved up and down therewith.

Hereinafter, an operation of the bowling ball resurfacing device will be set forth. As a method of resurfacing a bowling ball B of the present invention, there are two methods, i.e., a method of polishing the surface of the bowling ball B, and a method of abrading the surface of the bowling ball B. Hereinafter, the bowling ball polishing method and the bowling ball abrading method will be explained in classified.

First, explaining the method of polishing the bowling ball B, as shown in FIG. 1, the bowling ball B, requiring a polishing, is located on the first and the second vertical supporting rollers 112 and 122 and the first and the second horizontal rollers 132 and 142, then, a start button is pushed. As a result, as shown in FIG. 5*a*, the first and the second vertical supporting rollers 112 and 122, and the first and the second horizontal supporting rollers 132 and 134 are rotated to revolve the bowling ball B. At this time, the first and the second vertical supporting rollers 112 and 122, and the first and the second horizontal supporting rollers 132 and 142 change the rotational axis of the bowling ball B from "X" to "Z" and from "Z" to "X" in various.

On the other hand, as the start button is pushed, as shown in FIG. 1, the lower wheel assembly 210 is also rotated to resurface the lower surface of the bowling ball B. At this time, only the polishing wheel 230 of the lower wheel assembly 210 is contacted with the surface of the bowling ball B to polish the bowling ball B.

In addition, as the start button is pushed, the lifting motor 370 of the upper resurfacing unit 300 is operated, thus, as shown in FIG. 9, the upper wheel assembly 320 is moved down with rotating, thereby resurfacing the surface of the bowling ball B. On the other hand, the lifting motor 370 stops operating thereof as the upper wheel assembly 320 is arrived at the first position, thus, the upper wheel assembly 320 resurfaces the surface of the bowling ball B, fixed at the first position. At this time, only the polishing wheel 340 of the upper wheel assembly 320 is contacted with the surface of the bowling ball B to polish the bowling ball B.

Through these series of operating processes, the polishing wheel 340 of the upper wheel assembly 320 and the polishing wheel 230 of the lower wheel assembly 210 are contacted with the upper surface and the lower surface of the bowling ball B to polish the surfaces of the bowling ball B.

On the other hand, during the upper wheel assembly 320 and the lower wheel assembly 210 polish the surface of the bowling ball B, the first and the second vertical supporting rollers 112 and 122, and the first and the second horizontal supporting rollers 132 and 142 change the rotational axis of the bowling ball B in various directions. Therefore, a contact region between the bowling ball B and the upper and the lower wheel assemblies 320 and 210 is changed in various, thereby uniformly polishing the entire surface of the bowling ball B.

Next, the method of abrading the bowling ball B will be explained. First, as shown in FIG. 1, the bowling ball B, requiring an abrading, is located on the first and the second vertical supporting rollers 112 and 122 and the first and the second horizontal rollers 132 and 142, then, a start button is pushed. As a result, the first and the second vertical supporting rollers 112 and 122, and the first and the second horizontal supporting rollers 132 and 134 are rotated to revolve the bowling ball B. At this time, the first and the second vertical supporting rollers 112 and 122, and the first and the second horizontal supporting rollers 132 and 142 change the rotational axis of the bowling ball B from "X" to "Z" and from "Z" to "X" in various.

On the other hand, as the start button is pushed, the lifting motor 370 and the driving motor 360 of the upper resurfacing unit 300 is also operated, thus, the upper wheel assembly is moved down with rotating to be close contacted with the upper surface of the bowling ball B. On the other hand, as shown in FIG. 10, the lifting motor 370 moves the upper wheel assembly 320 to the second position, thus, the upper wheel assembly 320 resurfaces the surface of the bowling ball B in a state fixed at the second position. At this time, the polishing wheel 340 and the abrading wheel 330 of the upper wheel assembly 320 are coincidently contacted with the surface of the bowling ball B to abrade the bowling ball B. Especially, the abrading wheel 330 having rough particles roughly abrades the surface of the bowling ball B.

Further, when a predetermined time is lapsed after the accomplishment of the rough abrading to the bowling ball B, as shown in FIGS. 8 and 9, the lifting motor 370 is reversely rotated to elevate the upper wheel assembly 320 from the second position to the preparation position. Then, when the upper wheel assembly 320 is moved up to the preparation position, as shown in FIG. 9, the lifting motor 370 is rotated forward again to locate the upper wheel assembly 320 at the first position. At this time, the polishing wheel 340 of the upper wheel assembly 320 is only contacted with the upper surface of the bowling ball B.

On the other hand, when the polishing wheel 340 of the upper wheel assembly 320 is contacted with the upper surface of the bowling ball B, as shown in FIG. 7, the lifting motor 266 and the driving motor 250 of the lower resurfacing unit 200 are promptly operated, thus, the abrading wheel 220 of the lower wheel assembly 210 is moved up with rotating to be contacted with the lower surface of the bowling ball B. At this time, the surface of the bowling ball B is finely abraded by the abrading element 225 of the abrading wheel having fine particles.

When a predetermined time is lapsed after the fine abrading to the bowling ball B, as shown in FIGS. 8 and 9, the lifting motor 370 is reversely rotated to elevate the upper wheel assembly 320 from the first position to the preparation position. Then, when the upper wheel assembly 320 is moved up to the preparation position, as shown in FIG. 9, the lifting motor 370 is rotated forward again to locate the upper wheel assembly 320 at the first position. At this time, the polishing wheel 340 of the upper wheel assembly 320 is only contacted with the upper surface of the bowling ball B, thereby polishing the surface of the bowling ball B.

Figure 6:
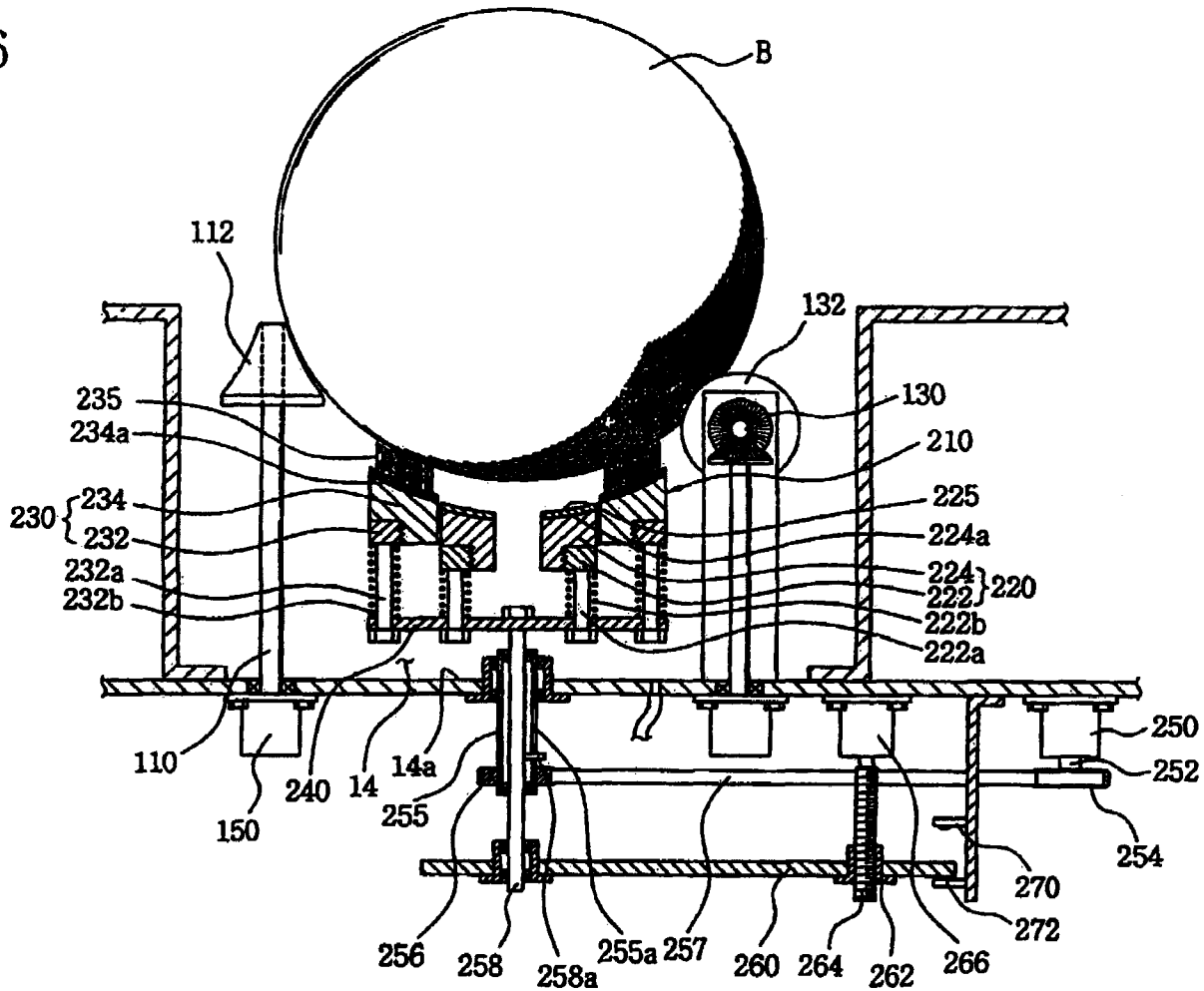
FIG. 6 is an enlarged cross-sectional view illustrating a lower resurfacing unit incorporated in the bowling ball resurfacing device in accordance with the present invention.

When the polishing wheel 340 of the upper wheel assembly 320 is contacted with the upper surface of the bowling ball B, as shown in FIGS. 6 and 7, the lifting motor 266 of the lower resurfacing unit 200 is reversely rotated to move downwards the abrading wheel 220 of the lower wheel assembly 210. At this time, the polishing wheel 340 of the upper wheel assembly 320 is only contacted with the surface of the bowling ball B to thereby polish the surface of the bowling ball B.

When a predetermined time is lapsed after the polishing process of the upper wheel assembly 320 and the lower wheel assembly 210, as shown in FIG. 8, the lifting motor 370 of the upper resurfacing unit 300 is reversely rotated, thereby spacing apart the upper wheel assembly 320 from the is bowling ball B. Then, each driving motors 250 and 360 of the lower resurfacing unit 200 and the upper resurfacing unit 300 is halted, thereby completing the resurfacing process of the bowling ball B.

Through these series of operation processes, the abrading element of the upper wheel assembly 320 and the lower wheel assembly 210 is changed in order from large particles to small particles to abrade the bowling ball B. On the other hand, the control board 16 controls a series of processes of moving the lower wheel assembly 210 and the upper wheel assembly 320 upwards and downwards.

INDUSTRIAL APPLICABILITY OF THE INVENTION

As fully described above, the bowling ball resurfacing device in accordance with the invention has the ability to revolve the bowling ball in various directions and cleanse, abrade, polish and furbish the entire surface of the bowling ball without an unbalanced wear. Further, the device is capable of resurfacing the surface of the bowling ball by use of various abrading or polishing wheels previously prepared.

What is claimed is:

1. A bowling ball resurfacing device, comprising:

a housing;

a first and a second vertical support rollers mounted to the housing in a spaced-apart relationship with each other for rotation about parallel vertical axes, each of the vertical support rollers adapted to make contact with the surface of the bowling ball at one lateral bottom side of the bowling ball;

a first and a second horizontal support rollers mounted to the housing for stably supporting the bowling ball in cooperation with the first and the second vertical support rollers, each of the horizontal support rollers rotatable about horizontal axes and adapted to make contact with the surface of the bowling ball at the other lateral bottom side of the bowling ball;

roller driving means for rotating the first and the second vertical support rollers and the first and the second horizontal support rollers;

abrading-and-polishing means for making frictional contact with the surface of the bowling ball to abrade or polish the bowling ball while the bowling ball is in rotation.

2. The device as recited in claim 1, wherein the abrading-polishing means include a lower wheel assembly installed at a lower portion of the housing to be rotated about a vertical axis, and in contact with the lower surface of the bowling ball to abrade or polish the lower surface of the bowling ball.

3. The device as recited in claim 2, wherein the lower wheel assembly includes a supporting plate, an abrading wheel attached to the supporting plate to move in the direction of approaching or spacing apart to/from the bowling ball, a spring for resiliently biasing the abrading wheel to the bowling ball, an annular polishing wheel attached to the supporting plate to move in the direction of approaching or spacing apart to/from the bowling ball, and disposed around the abrading wheel in concentric relationship, and a spring for resiliently biasing the polishing wheel to the bowling ball.

4. The device as recited in claim 3, wherein the polishing wheel is normally located more adjacent to the surface of the bowling ball than the abrading wheel.

5. The device as recited in claim 2, wherein the lower wheel assembly is installed at the housing to move in the direction of approaching or spacing apart to/from the bowling ball.

6. The device as recited in claim 1, wherein the abrading-polishing wheel includes an upper wheel assembly installed at an upper portion of the housing to be rotated about a vertical axis, and in contact with the upper surface of the bowling ball to abrade or polish the upper surface of the bowling ball.

7. The device as recited in claim 6, wherein the upper wheel assembly includes a supporting plate, an abrading wheel attached to the supporting is plate to move in the direction of approaching or spacing apart to/from the bowling ball, a spring for resiliently biasing the abrading wheel to the bowling ball, an annular polishing wheel attached to the supporting plate to move in the direction of approaching or spacing apart to/from the bowling ball, and disposed around the abrading wheel in concentric relationship, and a spring for resiliently biasing the polishing wheel to the bowling ball.

8. The device as recited in claim 7, wherein the polishing wheel is normally located more adjacent to the surface of the bowling ball than the abrading wheel.

9. The device as recited in claim 6, wherein the upper wheel assembly is installed at the housing to move in the direction of approaching or spacing apart to/from the bowling ball.

10. The device as recited in claim 1, further comprising an abrading fluid supplying means for supplying an abrading fluid to the surface of the bowling ball.

* * * * *